US007134312B2

(12) United States Patent
Yamanaka et al.

(10) Patent No.: US 7,134,312 B2
(45) Date of Patent: Nov. 14, 2006

(54) DIE APPARATUS AND DIE EXCHANGING METHOD IN PRESSING MACHINE

(75) Inventors: Shigeaki Yamanaka, Hiroshima (JP); Takeshi Kazama, Hiroshima (JP)

(73) Assignee: Kubota Iron Works Co., Ltd., Hiroshima (JP)

( * ) Notice: Subject to any disclaimer, the term of this patent is extended or adjusted under 35 U.S.C. 154(b) by 319 days.

(21) Appl. No.: 10/713,168

(22) Filed: Nov. 13, 2003

(65) Prior Publication Data

US 2005/0103089 A1 May 19, 2005

(51) Int. Cl.
*B21D 7/02* (2006.01)
*B21D 37/04* (2006.01)

(52) U.S. Cl. ..... 72/446; 72/448; 72/481.1; 72/481.8

(58) Field of Classification Search ..... 72/446, 72/448, 481.1, 481.3, 481.8
See application file for complete search history.

(56) References Cited

U.S. PATENT DOCUMENTS

| | | | | | |
|---|---|---|---|---|---|
| 1,190,696 | A | * | 7/1916 | Wilzin | 72/473 |
| 1,234,654 | A | * | 7/1917 | Gaynor | 72/473 |
| 3,269,168 | A | | 8/1966 | Anderson | |
| 3,673,908 | A | * | 7/1972 | Smith | 72/446 |
| 4,301,673 | A | | 11/1981 | Yonezawa | |
| 4,317,358 | A | | 3/1982 | Yonezawa et al. | |
| 4,485,549 | A | * | 12/1984 | Brolund | 72/446 |
| 4,958,966 | A | * | 9/1990 | Andrews | 279/83 |
| 5,000,022 | A | * | 3/1991 | Shinkai et al. | 72/448 |
| 5,613,693 | A | * | 3/1997 | Ramunas | 83/698.91 |
| 6,134,938 | A | | 10/2000 | Ohtsuka | |
| 2005/0103088 | A1 | | 5/2005 | Yamanaka et al. | |

* cited by examiner

*Primary Examiner*—David B. Jones
(74) *Attorney, Agent, or Firm*—Frishauf, Holtz, Goodman & Chick, PC

(57) ABSTRACT

Improved die arrangements are provided whereby both an upper die and a lower die can easily be loaded into and unloaded from their respective die holders in a die exchanging operation. An improved die apparatus in a pressing machine in which an upper die set is securely loaded in an upper die holder fastened to a slide side for a pressing operation, comprises an arrangement whereby the upper die set is held in the upper die holder so that the upper die set can be extracted downwards from the upper die holder, wherein the upper die holder is provided with stopper means adapted to engage with the upper die set to hold the upper die set in place and adapted to disengage from the upper die set to allow the upper die set to disengage from the upper die holder.

2 Claims, 4 Drawing Sheets

DIE APPARATUS AND DIE EXCHANGING METHOD IN PRESSING MACHINE

BACKGROUND OF THE INVENTION

1. Field of the Invention

The present invention relates to a die apparatus and a die exchanging method in a pressing machine.

2. Description of the Prior Art

A die apparatus in a pressing machine comprises a lower die unit in which a lower die set containing lower die members is received in a lower die holder and an upper die unit in which an upper die set containing upper die members is received in an upper die holder. And, with the lower and upper die holders securely fixed to a lower and an upper die plate, respectively, which are in turn securely fixed to a bolster and a slide, respectively, the lower and upper die units are securely held by the bolster and the slide, respectively.

An existing die apparatus of this type, in which the lower and upper die units are each dealt with as an assembly, has been so designed that when the lower and upper dies are each exchanged, the lower and upper die units each with its die holder must wholly be removed from the bolster and slide, respectively, and in the outside of the machine each of the lower and upper dies must, by means of a chain hoist or the like, be extracted upwards from the die holder, together with a plate in which it is circumferentially fitted and must then be decomposed.

Thus, in the conventional die apparatus, since it is necessary to remove two such die units together with their respective die holders into the machine's outside each time a lower and an upper die are exchanged and further to extract upwards each of the lower and upper dies from its die holder, together with a plate in which it is circumferentially fitted, respectively, there has been encountered the problem that quite a time-consuming die exchanging operation is required.

BRIEF SUMMARY OF THE INVENTION

With the forgoing taken into account, the present invention has an object aimed at providing an improved die apparatus for a pressing machine, having an upper and a lower die unit, whereby an upper die set can easily be unloaded from an upper die holder without unfastening the upper die holder from an upper die plate and likewise a lower die in a lower die set can easily be unloaded from a lower die holder without unfastening the lower die holder from a lower die plate, and whereby an upper die and a lower die set can both be exchanged easily.

In order to achieve the object mentioned above there is provided in accordance with the present invention a die apparatus in a pressing machine in which an upper die set is securely loaded in an upper die holder fastened to a slide side for a pressing operation, characterized in that it comprises an arrangement whereby the upper die set is held in the upper die holder so that the upper die set can be extracted downwards from the upper die holder, wherein the upper die holder is provided with stopper means adapted to engage with the upper die set to hold the upper die set in place and adapted to disengage from the upper die set to allow the upper die set to disengage from the upper die holder.

The present invention also provides a die apparatus in a pressing machine in which a lower die is securely loaded in a lower die fastened to a bolster side and an upper die set is securely held in an upper die holder fastened to a slide side for a pressing operation, characterized in that it comprises: a first arrangement whereby the lower die is held in the lower die holder so that the lower die can be extracted upwards from the lower die, wherein below the lower die there is provided a lower die lifting means for lifting up the lower die until it lies higher in position than an upper face of the lower die holder; and a second arrangement whereby the upper die set is held in the upper die holder so that the upper die set can be extracted downwards from the upper die holder, wherein the upper die holder is provided with stopper means adapted to engage with the upper die set to hold the upper die set in place and adapted to disengage from the upper die set to allow the upper die set to disengage from the upper die holder.

The present invention further provides a die exchanging method for a pressing machine, characterized in that it comprises the steps of: raising a lower die lifting means to lift up a lower die in a lower die holder until it lies higher in position than an upper face of the lower die holder, thereby unloading the lower die from the lower die holder; then, placing an upper die mounting and demounting jig on the raised lower die lifting means so that the upper die mounting and demounting jig lies coaxially with the lower die lifting means; moving down a slide having an upper die set fastened thereto via an upper die holder, followed by placing the upper die set on the upper die mounting and demounting jig so that the upper die set lies coaxially with the upper die mounting and demounting jig; releasing holding of the upper die set by the upper die holder, followed by raising the slide to allow the upper die set to be extracted downwards and thereby unloaded from the upper die holder; removing the upper die set from the upper die mounting and demounting jig; mounting a new upper die set on the upper die mounting and demounting jig so that the new upper die set lies coaxially with the upper die mounting and demounting jig; moving down the slide to allow the new upper die set to engage with the upper die holder, followed by fastening the new upper die set to the upper die holder; moving up the slide having the new upper die set held by the upper die holder; removing the upper die mounting and demounting jig from the raised lower die lifting means and mounting a new lower die on the latter; and lowering the lower die lifting means having the new lower die mounted thereon until the latter is loaded in the lower die holder.

According to the present invention, an upper die set is allowed to exit from the upper die holder by loosening the stopper means, and members making up the upper die set can be decomposed in the state that the upper die set is removed from the upper die holder. Also, a lower die is allowed to exit upwards from the lower die holder by the lower die lifting means.

BRIEF DESCRIPTION OF THE DRAWINGS

These and other objects, features and advantages of the present invention and other manners of its implementation will be more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
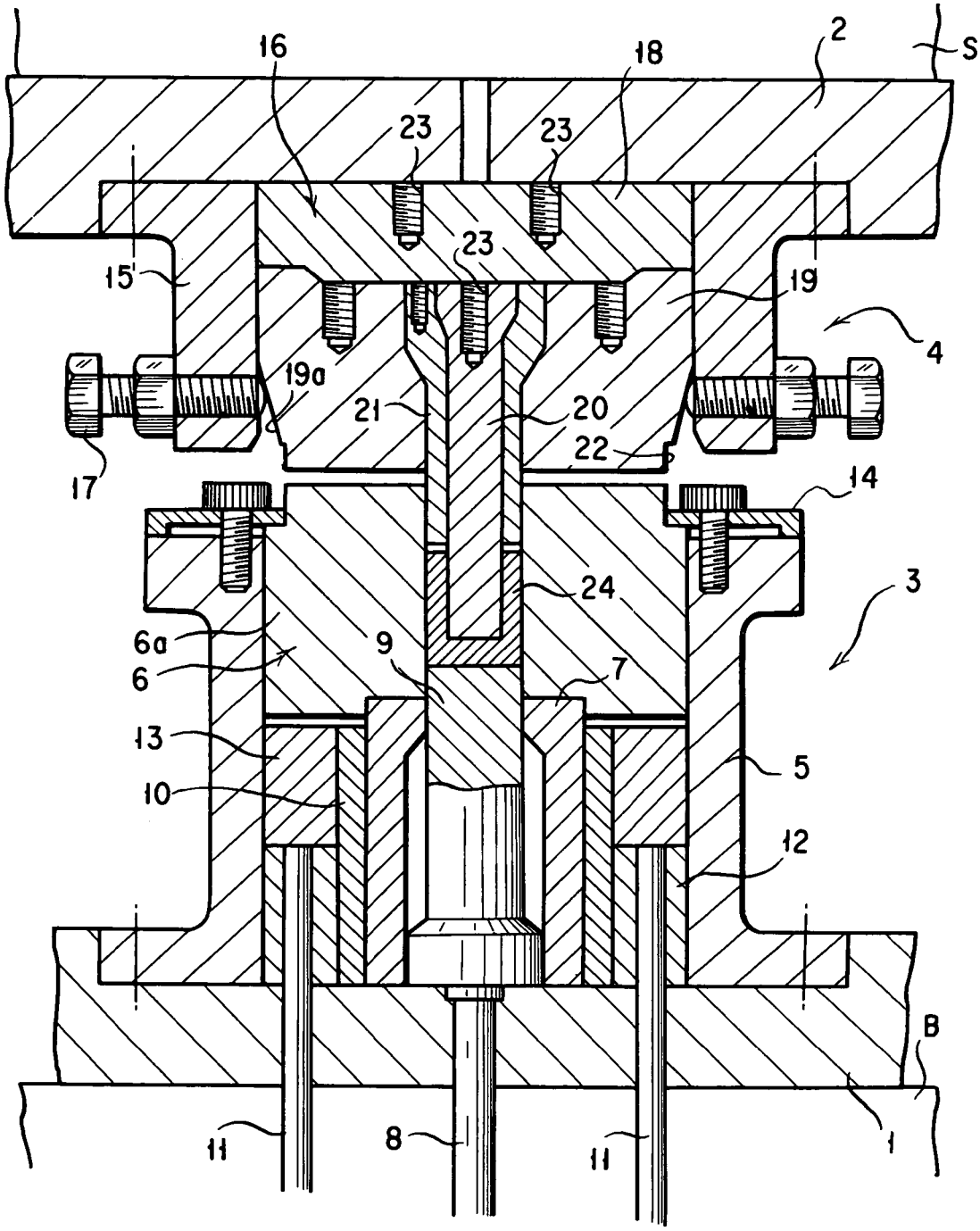
FIG. 1 is a cross sectional view illustrating a die apparatus according to the present invention in one form of implementation thereof.

An explanation is now given of one form of implementation of the present invention with reference to the Drawing Figures. In the Figures there are shown a lower die plate 1 fastened onto a bolster B, an upper die plate 2 fastened to a lower surface of a slide S, a lower die unit 3 fastened to the lower die plate 1, and an upper die unit 4 fastened to the upper die plate 2.

The lower die unit 3 as shown comprises a die holder 5 fastened to the lower die plate 1, and a lower die set 6 received in the lower die holder 5. The lower die set 6 includes a ring plate 7 mounted on the lower die plate 1, a lower die 6*a* mounted on the ring plate 7 so as to be slidably movable up and down in the lower die holder 5, and a knockout member 9 disposed in axial center of the ring plate 7 so as to be movable up and down and having its upper end facing the lower die 6*a* and its lower end opposed to the tip end of a knockout pin 8. The lower die set 6 also includes an imposition ring 10 mounted on the lower die plate 1 so as to fit over the ring plate 7, lift pins 11 and a lift pin guide member 12 fitted between the imposition ring 10 and the lower die holder 5 for guiding the lift pins 12 axially thereof, and a lower die takeout ring 13 disposed between the lift pin guide member 12 and the lower die 6*a* so as to be movable up and down. The lift pins 11 have their upper ends opposed to a lower face of the lower die takeout ring 13. The lower die 6*a* in the state that it is mounted on the ring plate 7 is fastened to the lower die holder 5 by a clamp means 14.

With the clamp means 14 unfastened and detached, the lower die 6*a* is lifted up by thrusting the same up with the lift pins 11 via the lower die takeout ring 13 until the lower end faces of the lower die 6*a* lies higher in position than the upper end face of the lower die holder 5.

The upper die unit 4 as shown comprises an upper die holder 15 fastened to the upper die plate 2, and an upper die set 16 received in the upper die holder 15 so that the former can be extracted downwards from the latter. The upper die set 16 is held in place by a plurality of stopper bolts 17 passing through the upper die holder 15 radially thereof.

The upper die set 16 comprises an upper plate member 18 and an upper die casing 19 on which it is mounted, and a punch 20 and an inner casing 21 which together constituting an upper die are received in the upper die casing 19 coaxially therewith so that they can be extracted from it upwards. The upper die casing 19 has a peripheral surface area 19*a* conically tapered where it is held in place by the stopper bolts 17 brought into engagement therewith, and terminates with a cylindrical section 22.

In the upper die set 16, each of the upper die plate member 18, the upper die casing 19, the punch 20 and the inner casing 21 has a hanger tap or taps 23 and is made capable of being hung up by a wire or wires via a hunger fitting or fittings in thread engagement therewith.

With the apparatus so made up as mentioned above, the lower die 6*a* is loaded with a formable material, and then the slide S is moved down to move the upper die unit 4 down whereby the material is formed into a formed product 24 as shown, by the lower die 6*a* and the upper die made of the punch 20 and the inner casing 21. Then, the formed product 24 is removed from the lower die 6*a* by raising the knockout member 9 after lifting up the upper die unit 4.

Mention is next made of a way of exchanging the lower die 6*a* and the upper die set 16 for the lower die unit 3 and the upper die unit 4.

Figure 2:
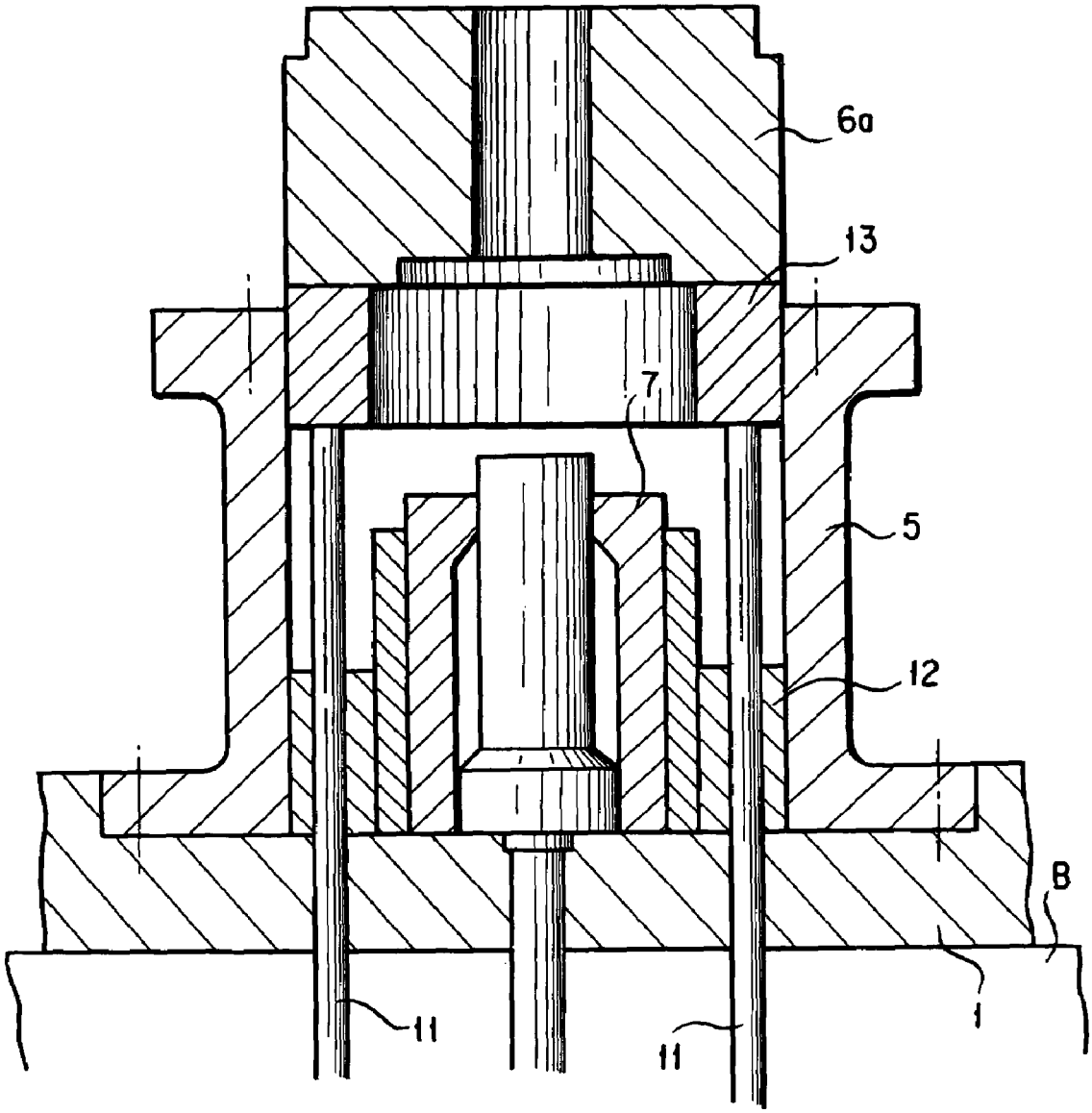
FIG. 2 is a cross sectional view illustrating the die apparatus in the state that a lower die has been unloaded.

The lower die 6*a* is exchanged upon lifting up the upper die unit 4. Referring to FIG. 1, first the clamp means 14 is unfastened and detached to release clamping of the lower die 6*a* to the lower die holder 5. Next, the lift pins 11 are raised to lift up the lower die takeout ring 13 with their upper ends and in turn to lift up the lower die 6*a* until its lower end lies higher in position than the upper end of the lower die holder 5 as shown in FIG. 2. Then, the lifted up lower die 6*a* is moved horizontally or hung up so as to be placed, for example, on a table (not shown) that has been prepared besides the upper die holder 15. The lower die 6*a* is thus taken out of the pressing machine. For setting a new lower die 6*a* in the lower die holder 5, a manner reverse to the above mentioned manner of removal is followed.

The upper die set 16 can be exchanged as stated below with reference to FIGS. 3 and 4. Here, the upper die set 16 is exchanged midway of the above mentioned operation of exchanging the lower die 6*a*, namely in the state where the lower die 6*a* is removed from the lower die holder 5. Further, in exchanging the upper die set 16, use is made of a cylindrical upper die mounting and demounting jig 25.

The upper die mounting and demounting jig 25 is provided in its lower side with a lower side fitting region 25*a* in fitting with the inner periphery of the lower die takeout ring 13 and in its upper side with an upper side fitting region 25*b* in fitting with the outer periphery of the cylindrical section 22 at the lower end of the upper die casing 19.

Figure 3:
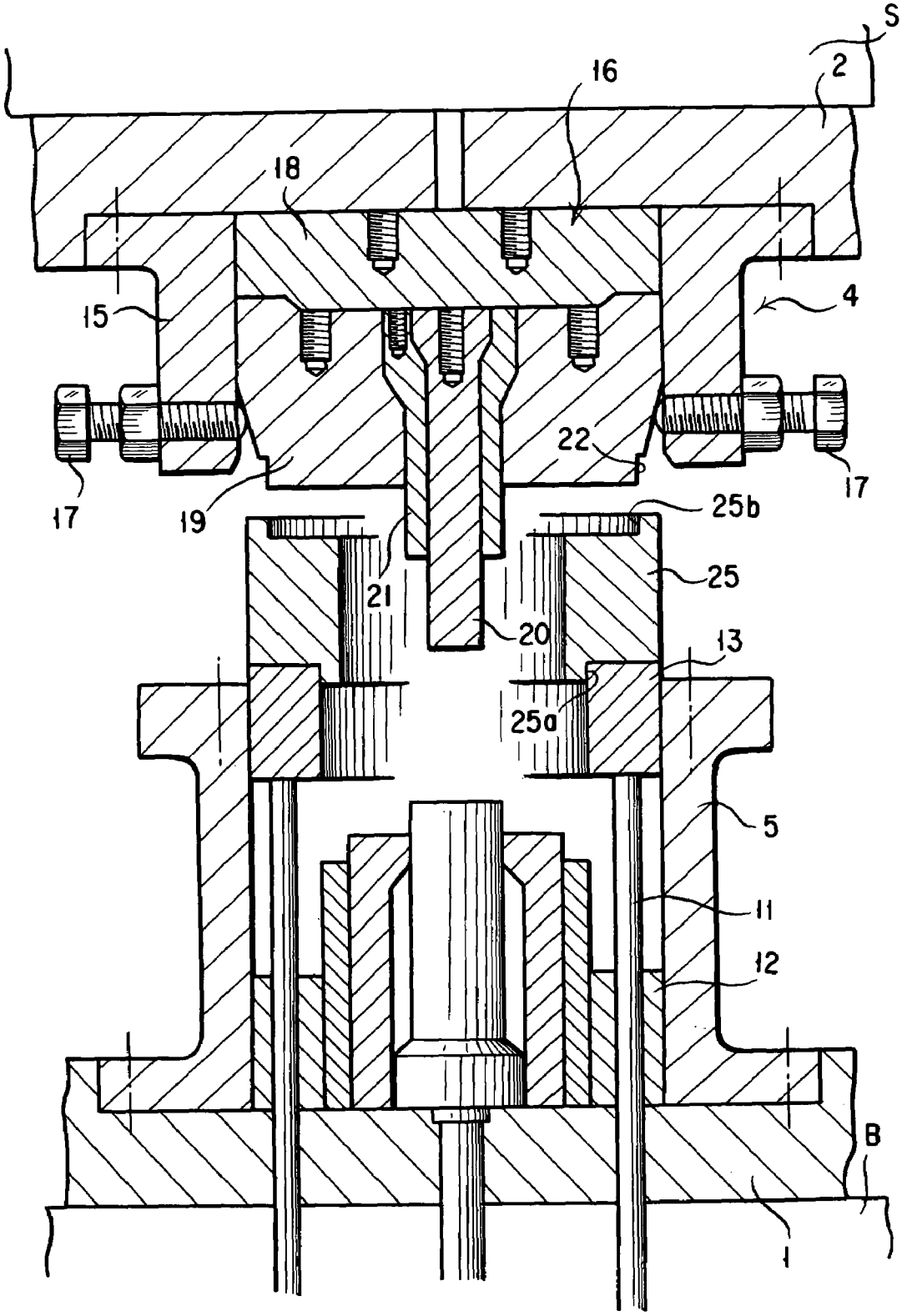
FIG. 3 is a cross sectional view illustrating the die apparatus in the state that an upper die is being unloaded.
Figure 4:
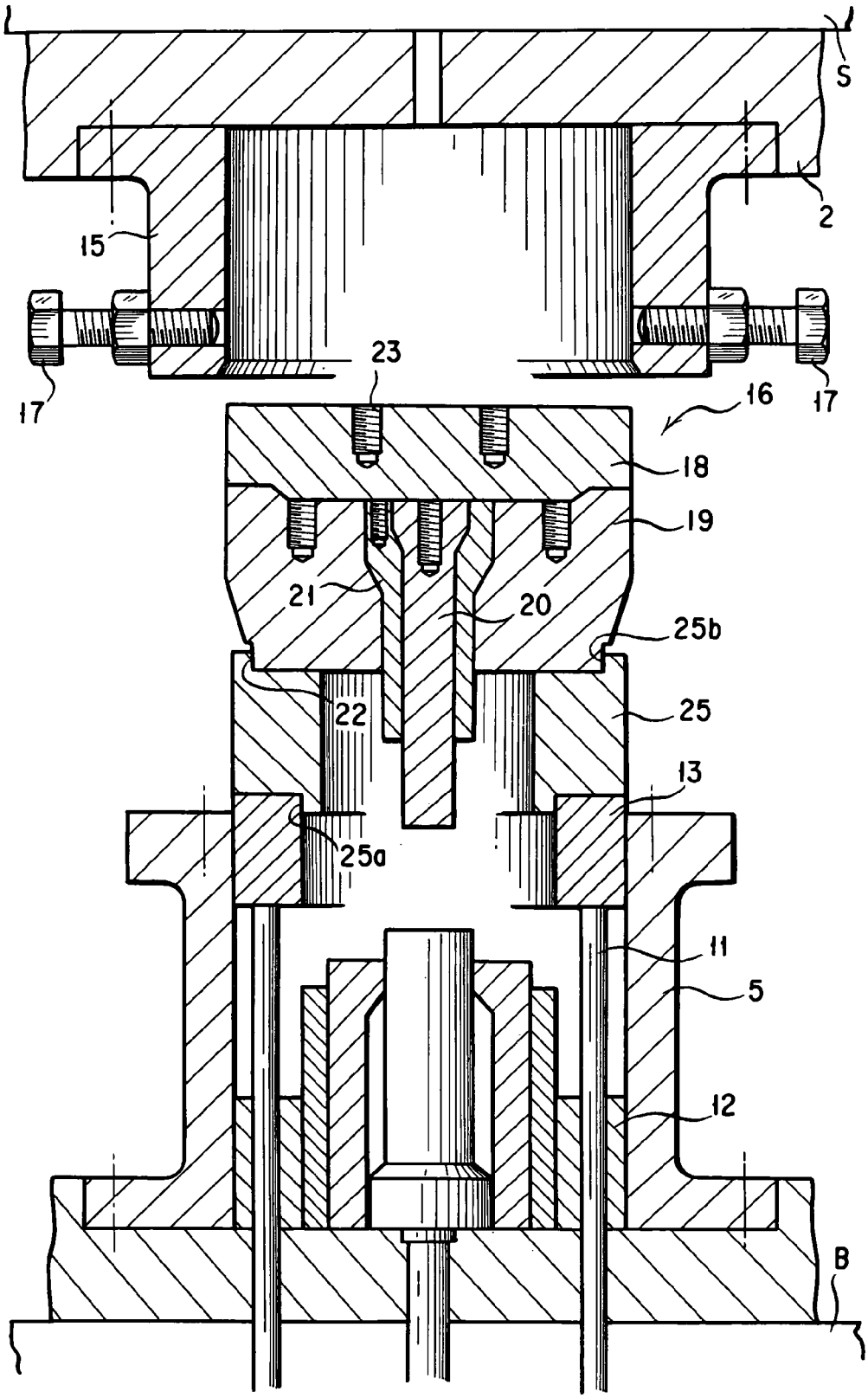
FIG. 4 is a cross sectional view illustrating the die apparatus in the state that the upper die has been unloaded.

In the state that the lower die 6*a* is removed from the lower die holder 5 as mentioned above, the upper die mounting and demounting jig 25 is set upon the raised lower die takeout ring 13 as shown in FIG. 3. Then, the slide S is moved down to a position at which only a small spacing exists between the lower face of the upper die casing 19 in the upper die unit 4 and the upper face of the upper die mounting and demounting jig 25. Thereafter, the lift pins 11 are pushed up to raise the lower die takeout ring 13 by a distance equal to the abovementioned small spacing and thereby to bring the upper face of the upper die mounting and demounting jig 25 into contact with the upper die casing 19. Now, the cylindrical section 22 of the upper die casing 19 has come into fitting with the upper side fitting region 25*b* of the upper die mounting and demounting jig 25.

Then, loosening the stopper bolts 17 to retract its tip end out of the inside of the upper holder 15 sets the upper die set 16 free from holding by the stopper bolts 17. Then, moving up the slide S leaves the upper die set 16 placed on the upper die mounting and demounting jig 25 while lifting up the upper die holder 15 as shown in FIG. 4.

The slide S is then moved up to lifting up the upper die holder 15 further until the slide S reaches its upper dead point. This produces and secures a wide space between the upper die holder 15 and the upper die set 16 extracted therefrom, where the upper die plate 18, the punch 20, the inner casing 21 and the upper die casing 19 are each demounted in this order. They are demounted by hanging them with wires tied to hanger accessories threaded with hanger taps 23 secured to them. In this case, lowering the lower die takeout ring 13 to lower the upper face of the upper die plate 18 will facilitate demounting these die set members.

When an another upper die set 16 is loaded in the upper die holder 15, that upper die set 16 is mounted on the upper die mounting and demounting jig 25 whereafter the slide S is moved down, and the upper die set 16 is accepted in the upper die holder 15 and is held in place with the stopper bolts 17. Then, using the upper die mounting and demounting jig 25 to dispose the upper die set 16 coaxially with the upper and lower die holders 15 and 5 facilitates accurately mounting the upper die set 16 in the upper die set 16 in the upper die holder 15.

A die apparatus according to the present invention allows an upper die set 16 to be removed from an upper die holder 15 to lie below it without removing the upper die set receiving upper die holder 15 from a slide S, thereby permitting the upper die set to be exchanged easily. The die apparatus also allows a lower die 6*a* in a lower die set 6 to be easily removed from a lower die holder 5 without removing the lower die set receiving lower die holder 5 from a bolster, thereby permitting the lower die to be exchanged easily.

A die changing method according to the present invention allows the upper die set 16 to be removed from the upper die holder as it is held coaxial with the upper die holder 15. When an another upper die set 16 is loaded in the upper die holder 15, using the upper die mounting and demounting jig 25 allows that upper die 16 to be disposed coaxially with the upper and lower die holders 15 and 5. Thus, any upper die set 16 can be loaded into and unloaded from the upper die holder easily.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. A die apparatus for a pressing machine, comprising:

a lower die securely loadable in a lower die holder fastened to a bolster side of a pressing machine such that the lower die is extractable upwards;

a lower die lifting mechanism which is provided below the lower die and which is operable to lift up the lower die until it lies higher in position than an upper face of the lower die holder;

an upper die set which is adapted to be held in an upper die holder by a stopper mechanism that is engageable with the upper die set to hold the upper die set in place in the upper die holder and that is disengageable from the upper die set to allow the upper die set to disengage from the upper die holder such that the upper die set is extractable downwards from the upper die holder; and an upper die mounting and demounting jig which is adapted to be removably positioned on the raised lower die lifting mechanism after the lower die is removed from the lower die lifting mechanism, such that the upper die mounting and demounting jig lies coaxially with the lower die lifting mechanism.

2. A die exchanging method for a pressing machine, said method comprising:

raising a lower die lifting mechanism to lift up a lower die in a lower die holder until the lower die lies higher in position than an upper face of the lower die holder, thereby unloading the lower die from the lower die holder;

then, placing an upper die mounting and demounting jig on the raised lower die lifting mechanism so that the upper die mounting and demounting jig lies coaxially with the lower die lifting mechanism;

moving down a slide having an upper die set fastened thereto via an upper die holder, and then placing the upper die set on the upper die mounting and demounting jig so that the upper die set lies coaxially with the upper die mounting and demounting jig;

releasing the upper die set from the upper die holder, and then raising the slide to allow the upper die set to be extracted downwards and thereby unloaded from the upper die holder;

removing the upper die set from the upper die mounting and demounting jig;

mounting a new upper die set on the upper die mounting and demounting jig so that the new upper die set lies coaxially with the upper die mounting and demounting jig;

moving down the slide to allow the new upper die set to engage with the upper die holder, and then fastening the new upper die set to the upper die holder;

moving up the slide having the new upper die set held by the upper die holder;

removing the upper die mounting and demounting jig from the raised lower die lifting mechanism and mounting a new lower die on the lower die lifting mechanism; and lowering the lower die lifting mechanism having the new lower die mounted thereon until the new lower die is loaded in the lower die holder.

* * * * *